United States Patent [19]

Tinker et al.

[11] Patent Number: 4,979,688

[45] Date of Patent: Dec. 25, 1990

[54] METHOD OF FEEDING YARN

[76] Inventors: Garnella P. Tinker, Rte. 7, Box 57, Rock Hill, S.C. 29730; Roland E. Goodwin, Rte. 1, Box 423B, Catawba, S.C. 29704

[21] Appl. No.: 449,434

[22] Filed: Dec. 11, 1989

Related U.S. Application Data

[62] Division of Ser. No. 254,593, Oct. 7, 1988, abandoned.

[51] Int. Cl.[5] ..... B65H 49/34; B65H 54/02

[52] U.S. Cl. ..... 242/47; 242/1; 242/54 DDR; 66/132 DDR

[58] Field of Search ..... 242/47, 53, 54 R, 18 R, 242/1, 2, 48, 49, 50; 66/1 A, 132 R

[56] References Cited

U.S. PATENT DOCUMENTS

| | | | |
|---|---|---|---|
| 2,340,888 | 2/1944 | Klumpp et al. | 66/132 |
| 2,583,087 | 1/1952 | Cloud et al. | 242/2 |
| 3,901,426 | 8/1975 | Zatopek et al. | 226/134 |
| 4,004,745 | 1/1977 | Booth | 242/54 R |
| 4,126,281 | 11/1978 | Young | 242/47 |
| 4,634,077 | 1/1987 | Wilson | 242/134 X |

FOREIGN PATENT DOCUMENTS

| | | | |
|---|---|---|---|
| 2393755 | 2/1979 | France | 242/18 R |
| 483730 | 8/1953 | Italy | 242/18 R |
| 203980 | 9/1923 | United Kingdom | 242/18 R |

*Primary Examiner*—Stanley N. Gilreath
*Attorney, Agent, or Firm*—Clifton Ted Hunt

[57] ABSTRACT

A motor driven bobbin is rotated in one direction to wind yarn on the bobbin for use in a hand craft and rotated in the opposite direction to feed yarn from the bobbin to form a temporary supply of slack yarn to be used in forming stitches in the hand craft. A foot actuated switch is operably connected to the motor to control its operation without interrupting the cycle of hand movements necessary to form stitches in the hand work.

3 Claims, 2 Drawing Sheets

METHOD OF FEEDING YARN

CROSS REFERENCE TO RELATED APPLICATION

This application is a division of our copending application, Ser. No. 254,593, filed Oct. 7, 1988 for YARN FEEDER, now abandoned.

FIELD OF THE INVENTION

This invention relates to the management and incremental feeding of a temporary supply of yarn to be used for forming stitches in a hand craft without interrupting the cycle of hand movements required to form the stitches in a hand craft, such as crocheting.

BACKGROUND OF THE INVENTION

Yarn used in hand crafts, such as crocheting, is commonly packaged by the manufacturer for the user in the form of a skein, cone, or ball. It is generally recognized that yarn packaged in this fashion is difficult for the user to handle while crocheting or performing any hand craft using yarn.

Working with a skein, cone, or ball of yarn is awkward because the user must repeatedly interrupt production of the craft to manually pull a few inches of yarn from the package to provide a slack area or a temporary supply of the yarn to be used in forming new stitches in the project. This means the user must repeatedly interrupt the normal cycle of hand movements required to complete the project with a consequent loss of production and accompanying irritability.

Working with a skein, cone, or ball of yarn has the additional disadvantage of the package of yarn tending to roll about, getting the yarn tangled and soiled as increments of yarn are pulled from it.

The user has the option of handling the yarn as packaged by the manufacturer, or reshaping the manufacturer's package into a more manageable package of yarn.

There are several devices in the prior art intended to help the user repackage yarn for a handcraft into a package more convenient to the user. See, for example:

- U.S. Pat. No. 4,126,281 issued Nov. 21, 1978 to Young for SKEINER;
- U.S. Pat. No. 4,634,077 issued Jan. 6, 1987 to Wilson for YARN CADDY;
- British Patent No. 203,980 of Sept. 20, 1923 for IMPROVEMENTS IN BOBBIN OR SPOOL WINDING APPLIANCES;
- Italian Patent No. 483,730 of Aug. 11, 1953 for WINDING DEVICE FOR UNWINDING A SKEIN OF YARN;
- British Patent No. 773,049 of Apr. 17, 1957 for KNITTING WOOL WINDER; and
- French Patent No. 2,393,755 of Jan. 5, 1979 for WINDING DEVICE TO UNWIND SKEIN OF YARN.

Each of these patents discloses apparatus for converting manufacturers' packages of hand craft yarn into packages more manageable for the user. Most of them put the yarn on a bobbin or spool. British Patent No. 773,049 converts skeins of yarn into balls.

None of the known prior art winders incrementally feeds yarn to the user as needed to form stitches to continue the project. In each instance, the user is left with the laborious task of repeatedly interrupting work on the project to pull a few inches of yarn from the reshaped package before work can continue on the project.

There is nothing that relieves the user of the known prior art winders from incrementally pulling yarn from a package as the work progresses and thereby repeatedly interrupting the cycle of hand movements necessary to form stitches while replenishing the supply of slack yarn needed for the formation of new stitches.

SUMMARY OF THE INVENTION

It is an object of the invention, therefore, to provide an apparatus that will wind a manufacturer's package of hand craft yarn into a convenient package for handling by the user, and will additionally enable the user to incrementally feed yarn from the package without interrupting the normal cycle of hand motions necessary to form the stitches in the completed hand craft.

It is a more specific object of the invention to provide a bobbin which can be rotated in one direction to wind yarn onto the bobbin from a skein, or other package of yarn provided by the yarn manufacturer. The bobbin can be rotated in the opposite direction to incrementally feed yarn from the bobbin as needed by the user.

In the illustrated embodiment of the invention the bobbin is rotated by an electric motor which is controlled by a foot switch operable by the user to feed yarn when desired. The electric motor may be operated by house current or by batteries, or the bobbin may be actuated by a spring mechanism, or otherwise, within the spirit of the invention. A carrying case is provided for portability.

DETAILED DESCRIPTION OF THE INVENTION

Figure 1:
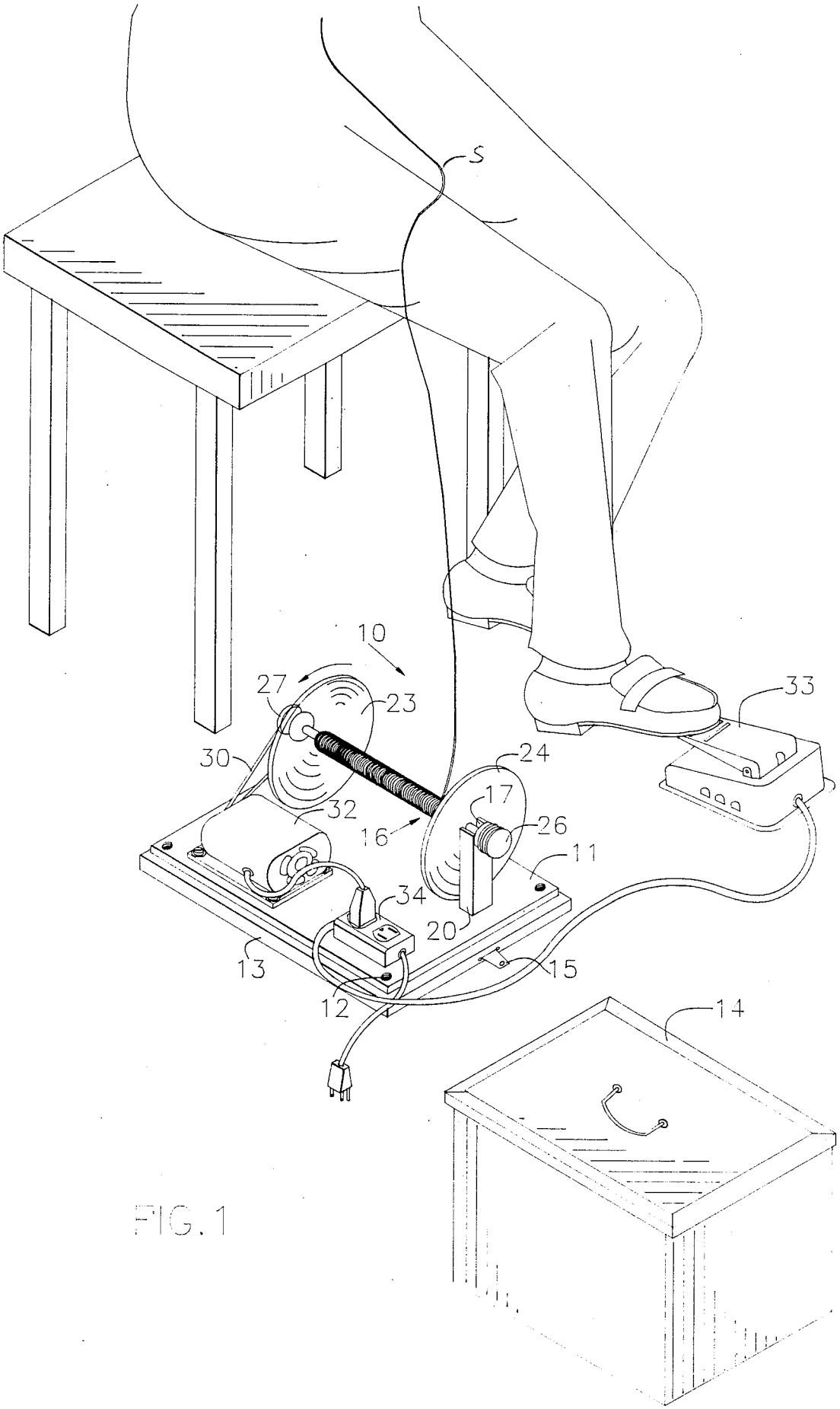
FIG. 1 is a perspective view illustrating the motor driven bobbin mounted on a base plate beside its carrying case and supported for rotation in one direction to incrementally feed off the yarn during the performance of a hand craft.
Figure 2:
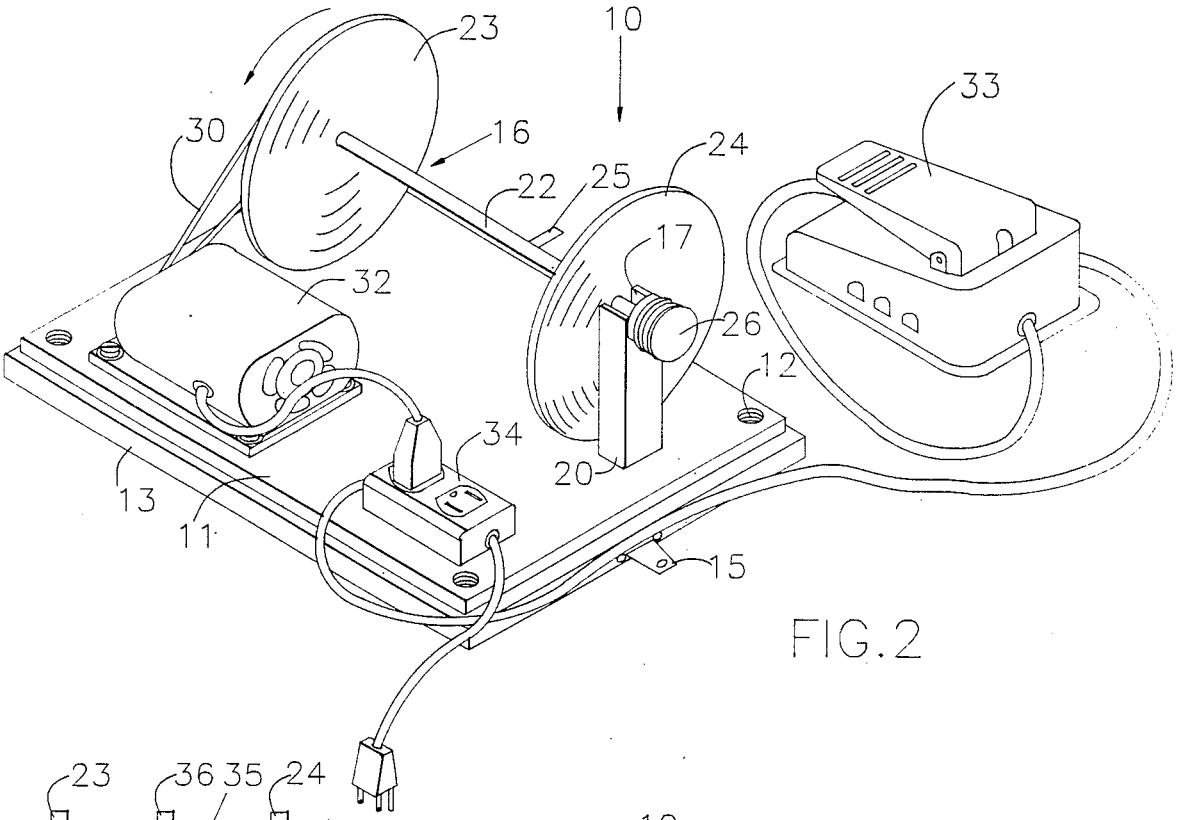
FIG. 2 is an enlarged perspective view similar to FIG. 1 but showing an empty bobbin and omitting the operator.

Referring more specifically to the drawings, the numeral 10 broadly designates a yarn feeder comprising a metal base 11 attached as by bolts 12 to a removable bottom wall 13 of a carrying case or cabinet 14. Fasteners 15 releasably connect the bottom wall 13 to the rest of the cabinet 14.

Figure 3:
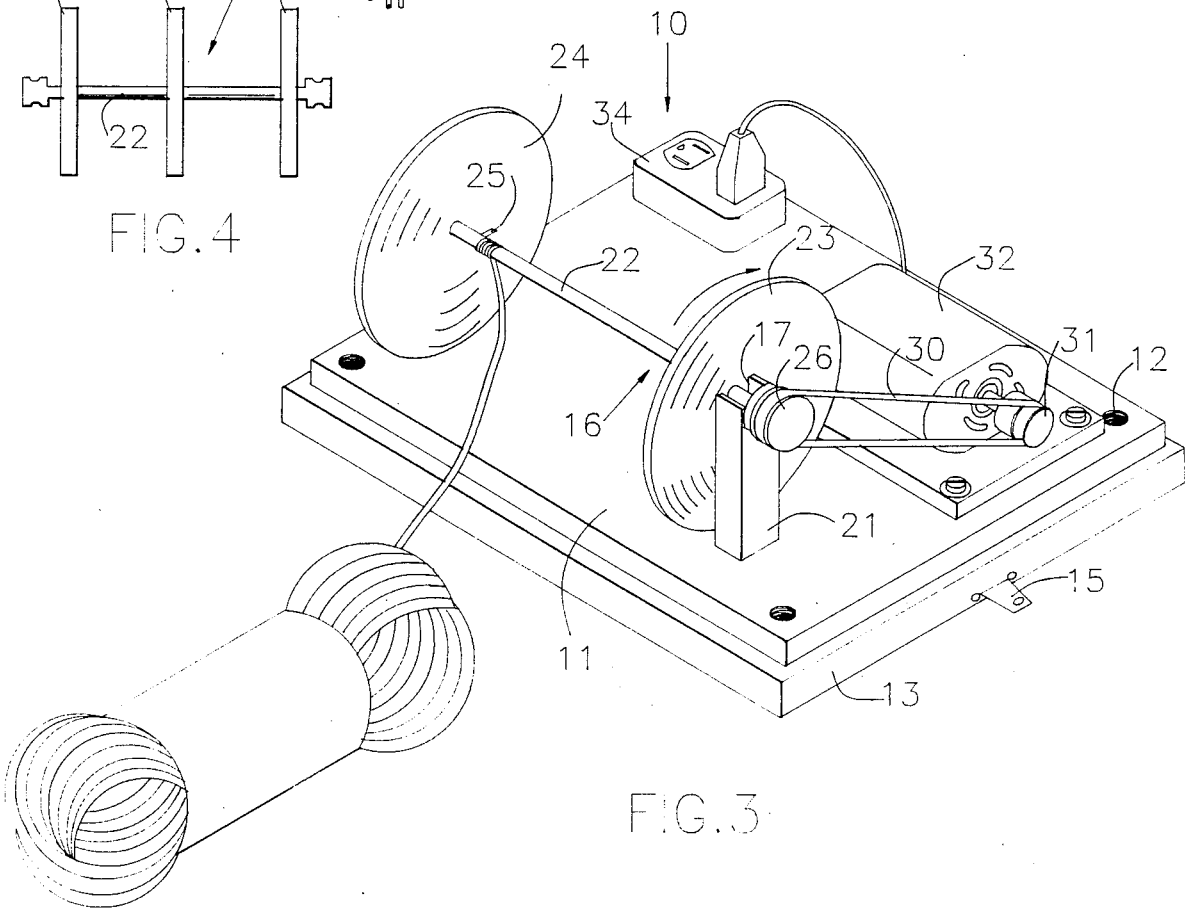
FIG. 3 is a perspective view of the apparatus looking at the side not shown in FIG. 2, and showing the bobbin repositioned in the stanchions to rotate in the opposite direction than indicated in FIGS. 1 and 2 to wind yarn on the bobbin from a skein.

A bobbin, broadly indicated at 16, is removably journaled for rotation in U-shaped upper ends 17 of stanchions 20 and 21 rising from the base 11. The bobbin 16 comprises a shaft 22 extending between and beyond end flanges 23 and 24. The shaft is journaled for rotation in the U-shaped upper ends 17 of the stanchions 20 and 21. An anchor pin 25 extends radially from the shaft 22 between the end flanges for connecting an end of yarn to the shaft preparatory to winding yarn onto the shaft, as shown in FIG. 3. In one satisfactory embodiment of the invention, the bobbin is sized to hold eight ounces of yarn, but the size of the bobbin is not critical.

Pulleys 26 and 27 are fixed to opposite ends of the shaft 22 beyond respective stanchions 20 and 21. A drive belt 30 extends from a drive shaft 31 of an electric motor 32 and about one of the pulleys 26 or 27, depending on whether the bobbin is to be rotated to wind yarn onto the bobbin or to feed yarn from the bobbin.

In the illustrated embodiment, the electric motor 32 operates in the range of 50 to 80 rpm, with 55 rpm being the preferred speed. An electric outlet 34 is mounted on the base 11 to be readily available when it is desired to use the yarn feeder.

The electric motor 32 can, of course, be reversible but is illustrated as not being reversible to demonstrate that the direction of rotation of the bobbin can be controlled by positioning the bobbin in the stanchions so that either the pulley 26 is engaged with the belt 30 to wind yarn on the bobbin as in FIG. 3, or the pulley 27 is engaged with the belt 30 to feed yarn from the bobbin, as in FIG. 1. The bobbin is lifted bodily and reversed in the stanchions when it is desired to change the direction of rotation of the bobbin.

A foot pedal switch 33 is actuated by the user to control operation of the motor. Use of the foot pedal switch to feed increments of yarn as needed relieves the user from the task of manually pulling yarn from the package and prevents interruption of the cycle of hand movement necessary to complete the project.

OPERATION

Referring to FIG. 1, the user uses the foot pedal switch 33 to actuate the motor 32 when it is time to replenish a temporary supply or slack area of yarn S to be used in the formation of stitches, not shown.

Figure 4:
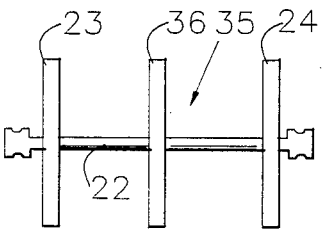
FIG. 4 is an elevation of a modified bobbin.

FIG. 4 illustrates a modified bobbin, broadly indicated at 35. Bobbin 35 differs from bobbin 16 only in that bobbin 35 includes a divider flange 36 located in the center of the shaft 22 between the end flanges 23 and 24. The divider flange 36 separates the bobbin into two portions to support two colors or types of yarn for selective use on the same project.

Several bobbins may be provided with a different color or type of yarn on each bobbin, and the bobbins interchanged on the stanchions to feed the desired yarn.

The yarn feeder 10 is also useful, with the bobbin 16 positioned as in FIG. 3, to unravel finished work after a mistake has been made.

SUMMARY

There is thus provided a yarn feeder which winds the yarn from the manufacturer's package onto a bobbin and feeds the yarn from the bobbin to replenish the small area of slack yarn as needed for the formation of additional stitches without interrupting the production of the project.

Although specific terms have been employed in describing the invention, they have been used in a descriptive sense only and not for purpose of limitation.

We claim:

1. A method of providing successive supplies of yarn for the manual formation of successive groups of stitches in a hand craft without interrupting the formation of stitches from a preceding supply of yarn, said method comprising the steps of:

(a) providing a supply of yarn, (b) providing a rotatable bobbin, (c) rotating the bobbin to wind yarn from said supply of yarn on the bobbin, (d) providing means other than manual for intermittently activating rotation of the bobbin to deliver yarn from the bobbin, and (e) repeatedly activating said means to rotate said bobbin to deliver successive supplies of yarn for the formation of successive groups of stitches in said hand craft while stitches are being formed in the hand craft from a preceding supply of yarn.

2. A method according to claim 1 wherein the supply of yarn is a manufacturer's yarn package.

3. A method according to claim 1 wherein the said means is an electric motor controlled by a foot switch.

* * * * *